United States Patent [19]

Gabriel, Jr.

[11] 4,215,949

[45] Aug. 5, 1980

[54] SELF CONTAINED ASPHALT PATCHING APPARATUS

[76] Inventor: Gifford W. Gabriel, Jr., 8198 S. Marshall, Littleton, Colo. 80123

[21] Appl. No.: 963,215

[22] Filed: Nov. 24, 1978

[51] Int. Cl.[2] ..... E01C 19/06

[52] U.S. Cl. ..... 404/110; 404/103; 404/101; 404/109; 404/133; 404/95

[58] Field of Search ..... 404/110, 75, 101, 83, 404/103, 95, 108, 109, 133, 84, 113

[56] References Cited

U.S. PATENT DOCUMENTS

| | | | |
|---|---|---|---|
| 2,589,257 | 3/1952 | Horning | 404/113 |
| 2,893,299 | 7/1959 | Moir | 404/113 |
| 3,217,620 | 11/1965 | Mindrum | 404/103 |
| 3,363,523 | 1/1968 | Brock | 404/113 X |
| 3,550,719 | 12/1967 | Meister | 404/133 X |
| 3,907,451 | 9/1975 | Fisher | 404/101 |
| 3,967,913 | 7/1976 | Gabriel | 404/109 |

*Primary Examiner*—Nile C. Byers, Jr.
*Attorney, Agent, or Firm*—Richard D. Law

[57] ABSTRACT

A motorized, wheeled vehicle having a lowerable asphalt supply hopper, includes a small supply asphalt bucket, with a positive discharge, mounted on an articulated arm, also mounted on the bucket is an adjustable height burner and a tack oil sprayer, and a tamper, and a material volume compensating auger transfers asphalt from the main hopper to the small supply bucket. A joy stick controller provides easy control of the operation of the components of the patching apparatus.

15 Claims, 10 Drawing Figures

FIG. 1
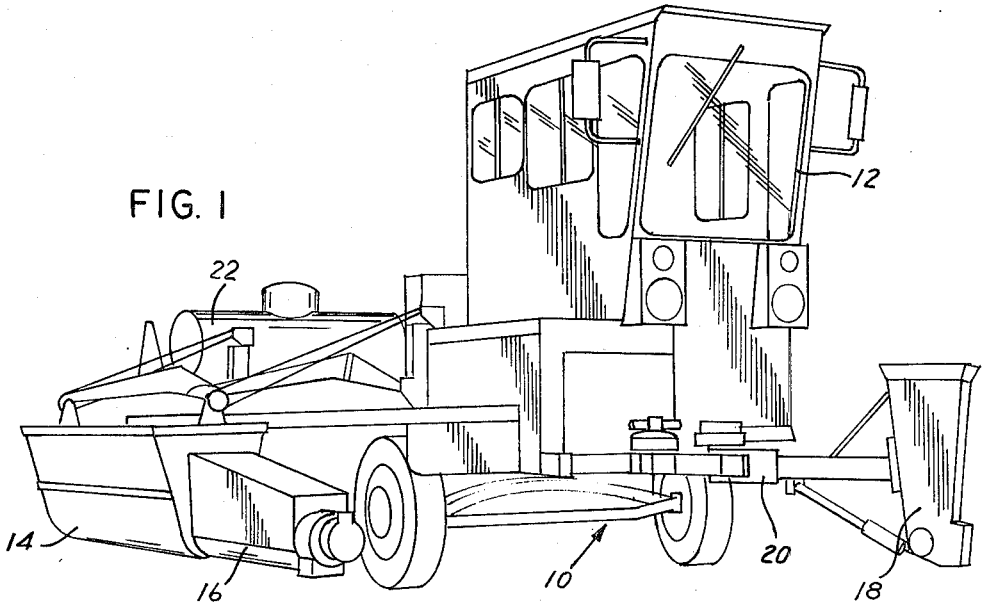
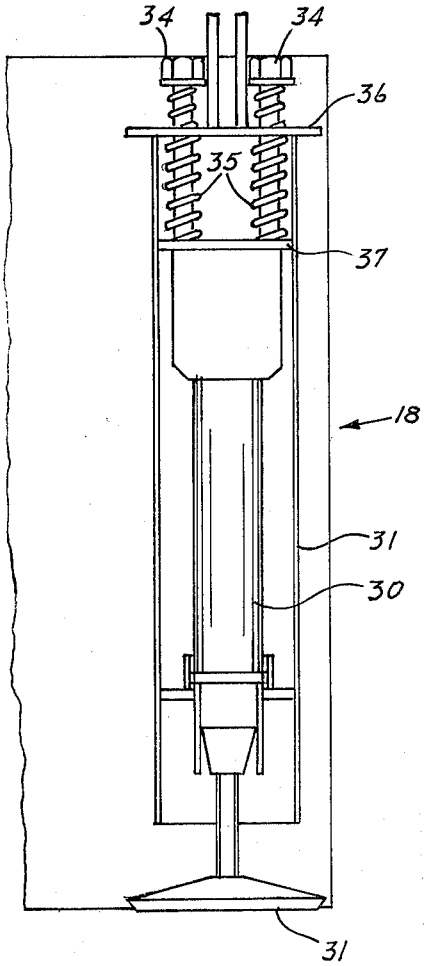
FIG. 2
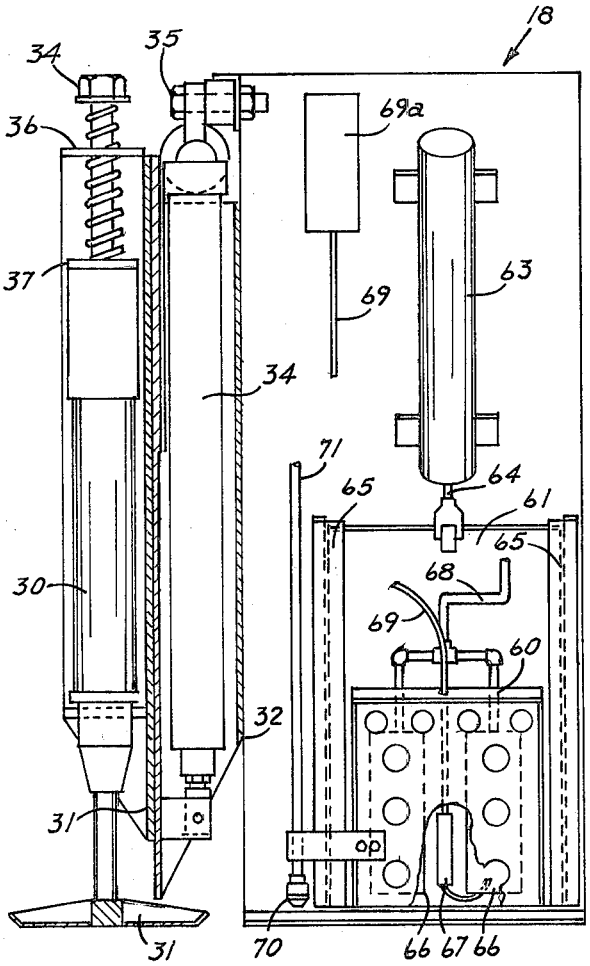
FIG. 3

SELF CONTAINED ASPHALT PATCHING APPARATUS

This invention relates to a one man operated asphalt patching apparatus, in which a main asphalt hooper is mounted on a motorized, wheeled vehicle, and a small bucket is mounted on an articulated arm for delivering a small amount of asphalt to holes to be patched in a road way. The necessary equipment for patching is, also, mounted with the bucket on the articulated arm, including an air blower, a burner tack oil spray, a tamper and a spreader for asphalt from the small bucket.

In my previous patent, U.S. Pat. No. 3,967,913 there is described a patching apparatus for asphalt roadways, and this included the means for transporting a supply of asphalt, as well as a small bucket on an articulated arm for transporting a small amount of asphalt to a pothole to be patched. The present invention provides improvements of my previous apparatus. These include a material volume compensating auger to convey asphalt to the small bucket from the main hopper, an adjustable burner, an adjustable height tamper, a spreader for asphalt from the small hopper and a one hand control column, in the form of a joy-stick, for control of patching operations. The mounting of a hopper and associated apparatus on an articulated arm may effectively use a jointed articulated arm in which the joints bend in a horizontal plane. This gives planar articulation of the outer end of the arm, without an unduly heavy articulated arm necessary to include a vertical component. The asphalt material and tamping apparatus on the end of the articulated arm constitutes a very heavy load, and for effectiveness must be cantilevered a substantial distance from its support. This arrangement requires a very sturdy arm to support the weight, and the horizontally bending joints provide accurate means to control the arm. Some vertical movement of various pieces of apparatus on the end of the arm is desirable for example, the burner, tack oil spray, tamper, etc. Also, hot asphalt is tacky, and on movement tends to compress and pack. An auger in an enclosed, relatively close fitting enclosure tube, quickly packs and blocks further movement of asphalt through the tube.

OBJECTS & ADVANTAGES OF THE INVENTION

Included among the objects and advantages of the invention is to provide an improved asphalt paving patching apparatus.

Another object of the invention is to provide an improved asphalt transfer auger from a supply hopper to a distribution bucket mounted on an articulated arm.

Still another object of the invention is to provide an improved burner assembly for an asphalt patching apparatus arranged to control the heating of a hole to be patched.

Yet another object of the invention is to provide an improved tamping mechanism for the machine tamping of asphalt in a hole to be patched.

A further object of the invention is to provide a height controllable tack oil sprayer for aiding patching operations.

An additional object of the invention is to provide a one hand control console for an articulated arm, asphalt patching apparatus using a plurality of tools on the articulated arm.

These and other objects and advantages of the invention will be apparent from the following description and appended drawings.

GENERAL DESCRIPTION OF THE DRAWINGS

FIG. 1 is a perspective view, in small detail, of an asphalt patching apparatus according to the invention, FIG. 2 is a front elevational view of a spring suppended tamping apparatus for an asphalt patching apparatus, FIG. 3 is a side elevational view of the repair tool carrying end of an asphalt patching apparatus, FIG. 4 is a side elevational view of an articulated arm carried asphalt hopper showing the lower discharge door means, FIG. 5 is a elevational view of an asphalt spreader means for asphalt discharged from the asphalt distribution bucke; FIG. 6 is a top plan view of a hot asphalt transport auger;

SPECIFIC DESCRIPTION OF THE DRAWINGS

Figure 4:
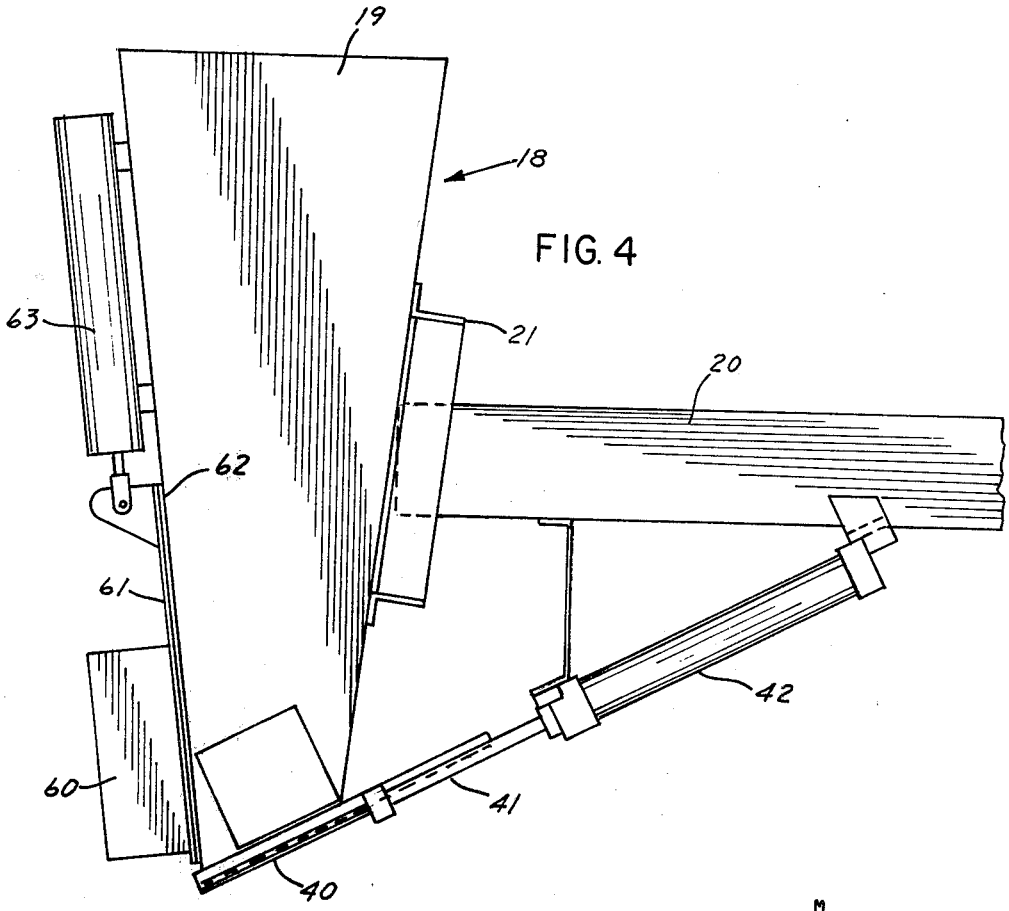

In the device illustrated in FIG. 1, a wheeled frame 10 includes a cab 12 having conventional controls for operating the vehicle on a roadway (including steering wheel, gear controls, etc,—not shown). A supply hopper 14 with an auger discharge 16 (detailed below) is arranged to be elevated up and on the frame for travelling and patching operations, and lowered to the roadway for filing. A distribution feeder bucket 18 with patching aids is mounted on an articulated, jointed arm 20 for movement during patching operations. The cab is made narrow to provide a high degree of visibility for patching operations, but is large enough for 2 passengers, who may be flagmen or the like. Also carried on the frams is a propane tank 22, in addition a hydraulic oil tank, diesel fuel tank, tack oil tank (none of which are shown) may be mounted on the frame.

Figure 5:
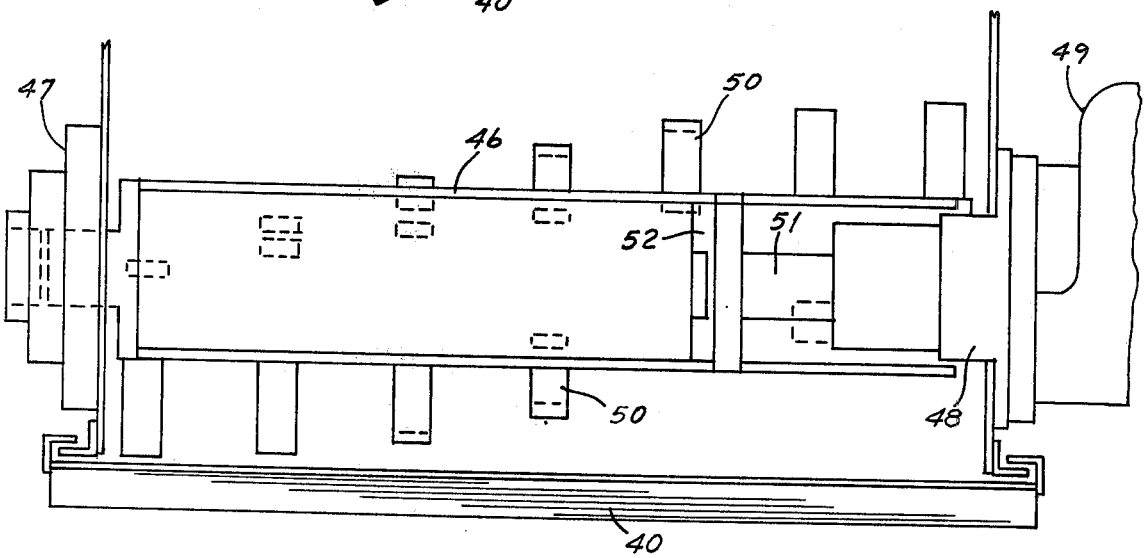

The distribution bucket 18, FIGS. 3–5, has a tamper 30 mounted on the bucket. The tamper has a square ($7\frac{1}{2}$ inches square) foot 31 with bevelled sides debouching upwardly from the foot. The tamper is a hydraulic cylinder tamper which operates at a high speed, preferably at about 2500 strokes per minute. This is afixed in a frame 31 reciprocably mounted on a base frame 32 and controlled as to height (in relation to the bucket) by a hydraulic cylinder 34, hydraulic or electric motor, as may be desired. The cylinder is anchored to the bucket by a bolt 35. The tamper cylinder 30 is mounted on take up springs (bolt mounted) 34, and pressure springs 35 between top plate 36 of frame 31 and a guide plate 37.

The distribution bucket 18 is generally rectangular with planar sides, diverging upwardly to a larger open top 19 (FIG. 4). As pointed out before the bucket is mounted on articulated arm 20, by means of frame assembly 21 secured to the bucket and the arm.

A bottom, sliding outlet door 40, on the bucket 18, secured to a piston rod 41 (reciprocated by a hydraulic cylinder 42 secured to the arm 20) opens and closes the bucket discharge for the controlled discharge of asphalt from the bucket. The asphalt in the bucket is aided in discharge and is spread by a rotary, horizontal member 46. This rotary member is journalled, by end journals 47 and 48, to the bucket, and is rotated by hydraulic motor 49 (only partially shown in FIG. 5). Such hydraulic motors are shelf items and well known. The rotary member 46 includes a plurality of radial paddles 50 (discontinuous spiral flights, spiral flights, etc) spaced longitudinally of the member and circumferentially of the member, providing mixing and discharge of the carried asphalt. The rotary member is mounted near the opening of the bucket to provide spreading of the asphalt as it is discharged. A shaft 51 from the motor 49 is secured in a support disc or web 52 internally of the rotary member 46 for rotating the same.

Mounted on the bucket, on the side opposite the articulated arm, is a burner assembly 60, mounted on a slide plate 61. The slide plate 61 is arranged for generally vertical reciprocating movement on base plate 62 mounted on the bucket, (FIG. 4), with conventional means, eg. side flanges 65, FIG. 3, for holding the two plates in face engagement for reciprocating movement. The sliding plate 61, and the burner assembly 60, are reciprocated by a cylinder 63, secured to the bucket, with its piston rod 64 secured to the plate 61. The burner assembly 60 includes a spaced pair of propane burners 66 mounted with an electric ignitor 67 in the assembly. A propane line 68, from the propane tank on the frame, bifurcates to feed the two burners. An electric lead 69 provides current for the ignitor through a controller 69*a* (a common electric mechanism).

A tack oil sprayer head 70 is mounted on the side of the burner assembly 60, providing raising and lowering of the sprayer head with the burner assembly. The sprayer is fed through line 71 leading to a tack oil tank and pump mounted on frame. The sprayer height for the tack oil is raised and lowered with the burners as desired. The raising and lowering is controlled by the operator, as explained below.

Figure 6:
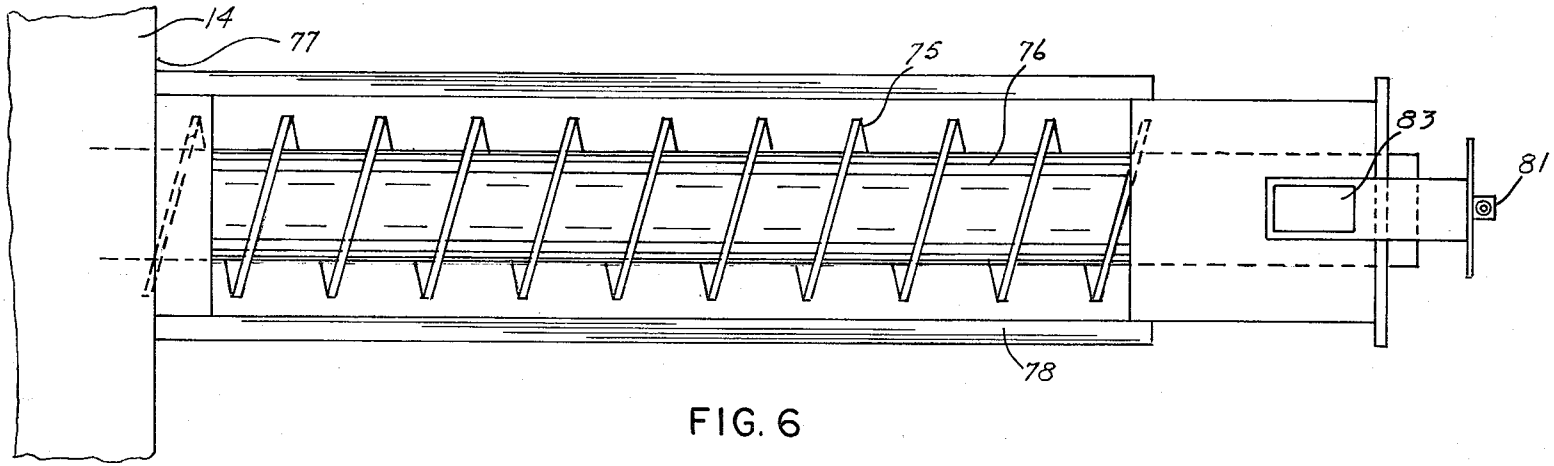
Figure 7:
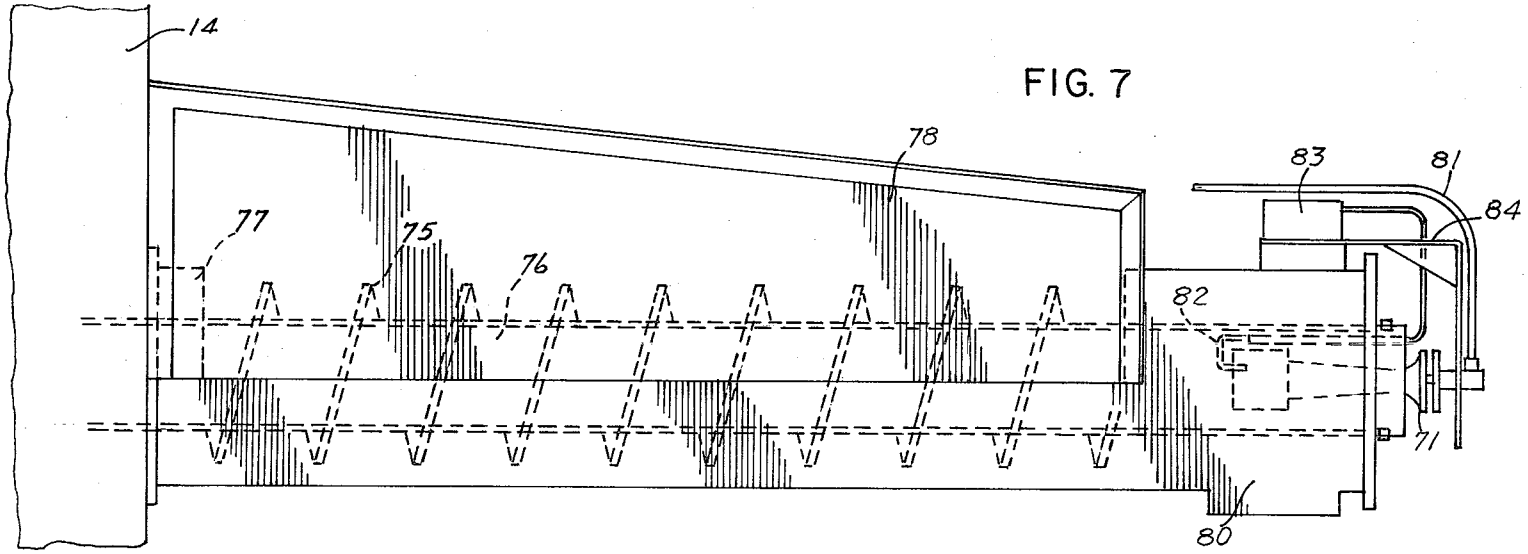
FIG. 7 is a side elevation of the auger of FIG. 6.
Figure 8:
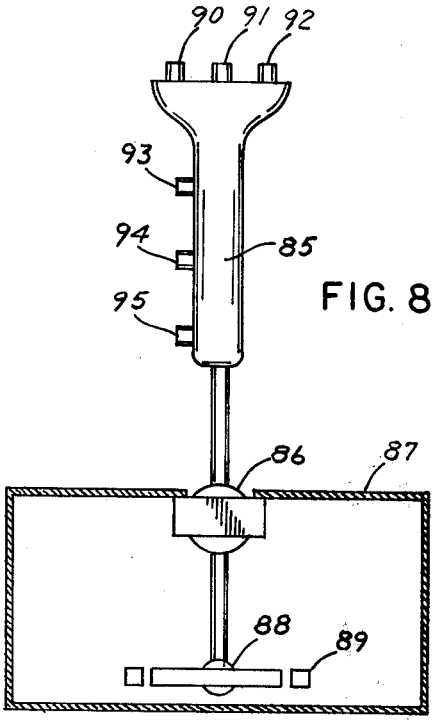
FIG. 8 is a schematic view (partially in section) of a joy stick controller according to the invention.

The main hopper 14 holds and heats asphalt for delivery to the bucket. The hopper is emptied by a spiral flight conveyor, partially shown in FIGS. 6–7, and it includes a hollow tube permitting a burner internally of the tube, to heat the asphalt, around the tube and in the discharge and hopper. A spiral flight 75 on a hollow tube 76, extends from inside the hopper 14, to an outlet 77 therefrom. The tube, exteriorly of the hopper, is journalled for rotation in the bottom of an open-top outlet discharge through 78 having a bottom asphalt discharge 80. A propane burner 81 at the outer end of the tube, fed by a propane line 81, is directed inwardly of the tube 76. An ignitor 82 electrically, ignites the burner (having a temperature control switch to maintain correct temperature) and it is connected to switching and control means 83, mounted on plate 84, controlled by the operator. The open-top discharge trough provides means for expansion of the asphalt discharged through the opening 77 by the auger, from the hopper. Asphalt, when confined as in a tube, tends to expand on movement and pack tightly in the tube. Thus, the open-top discharge trough has a higher wall adjacent the hopper 14 outlet accommodating the expansion, and slopes downwardly toward the downward discharge 80 under the trough. The wall is sloped as the asphalt spreads out on the conveyor after leaving opening 77.

The control, in the operator's cab, is a joy-stick type control column 85, mounted on a ball joint mount 86 in the switch console 87. The lower end of the joy-stick terminates in switch contactor 88 in position to contact a series of microswitches 89 (only one of which is identified). The joy-stick has a series of buttons connected to actuating switches (not shown) for operating the various elements of the patching unit. On the top of the controller is a spring loaded on-off switch button 90 which actuates the valve for two way cylinder 42 for opening the bucket gate, and on release of the button the valve reverses and piston extends closing the gate. The buttons control on-offs on momentary switches. The tamper cylinder 30 is actuated by depressing button 91 which controls a valve, and the hopper auger 76 is rotated by its controlling hydraulic motor (not shown) by depressing spring loaded on-off, on button 92. The spreader motor 49 is actuated by button 95 on the side of the joy-stick which remains off until depressed. The tack oil spray motor and pump (not shown) is actuated by spring loaded on-off button 94 to spray tack oil from the sprayer 70. The propane burners are fed propane and concurrently ignition current is applied to the ignitor by depressing spring loaded on-off button 93. Safety controls (standard) stop the propane in the event the burners do not ignite immediately.

Figure 10:
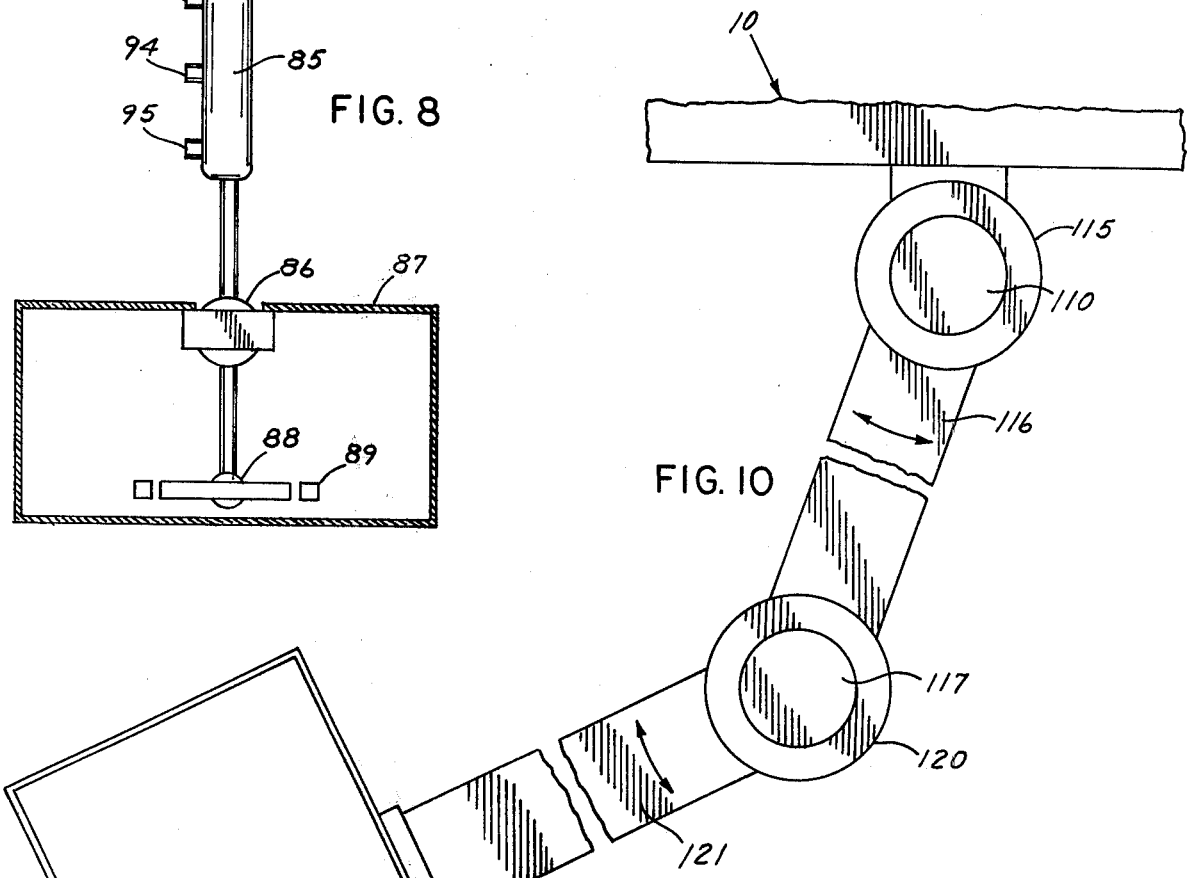
FIG. 10 is a schematic view of an articulated arm for the vehicle of the inspection.
Figure 9:
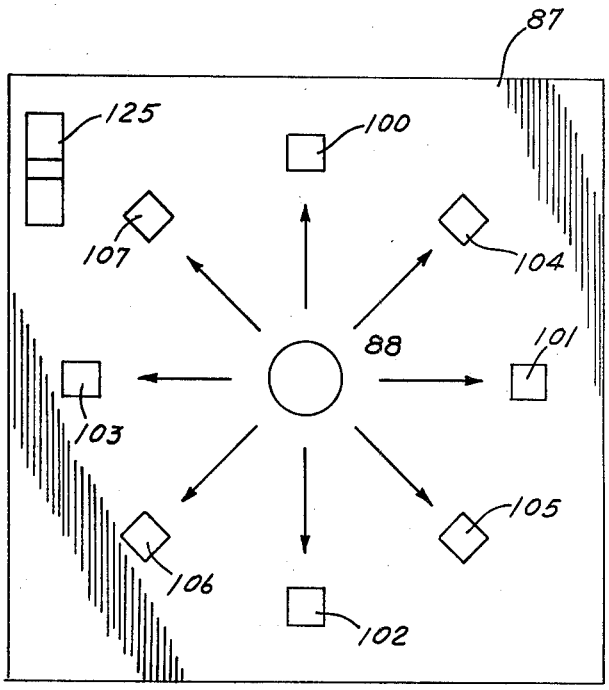
FIG. 9 is a schematic switch assembly for the controller of FIG. 8.

Movement of the joy-stick controller actuates the motivators (hydraulic motors) that position the arm. The stick is movable throughout 360° so that the contractor 88 may actuate a plurality of switches in the console. There is one switch at each of the four cardinal points, e.g. at 0° switch 100 or top of the console. Clockwise, FIG. 9, there is switch 101 at 90° to the right, switch 102 at 180° to the rear, and switch 103 at 270°. The switch 100 at 0° is activated as the stick is pulled back, causing the contactor 88 to move toward 0° activating switch 100. The switch activates a hydraulic valve (not shown) that activates motor 110 (FIG. 10) to rotate the shoulder 115 to the left, moving arm portion 116 to the left. The shoulder 115 is rotated to the right by pushing the stick forward actuating switch 102 controlling the motor 110 rotating the shoulder to the right. The elbow 120 of the arm is rotated to the left by moving the stick to the left so that contactor 88 actuates switch 101 controlling a motor 117 to turn arm 121 to the left. Moving the stick to the right causes contactor 88 to actuate switch 103 controlling a motor 117 to turn arm 121 to the right. The control motors are anchored on various portions to turn the attached portions, as set out in my earlier patent.

By moving the stick at a diagonal (to any 45° line) both the shoulder motors and elbow motors are actuated. Thus by moving the stick to cause contractor 88 to actuate switch 104 the shoulder is moved left and elbow to the right. The switch 105 cause the elbow and shoulder to both move to the right. Switch 106 causes the shoulder to move right and the elbow left, while switch 107 causes the elbow to move left and shoulder to the right. A direction reversing switch 125 changes polarity of the shoulder switches whenever the arm 116 passes the 0° mark.

The shoulder joint rotates about 180° from 90° to 270° through 0°, which is the straight ahead mark. The elbow joint rotates the bucket about 270° from left side of the arm 116 through 0° around to the right side of arm 116.

The patching unit supply hopper is sufficiently large to have an asphalt capacity for many small pot holes. It may be loaded at a hot mix plant, and then driven to the area to be patched. The unit generally remains in one side of a roadway so that the bucket can reach the potholes in that side. The patcher is positioned so that the pothole or potholes to be patched are in front of the vehicle in full view of the operator. A flagman or two may be carried in the cab if desired. When the hopper 14 is empty and the unit is not near a supply point, it may be supplied by a dump truck. For this purpose, the hopper is lowered to ground level and filled by a dump truck. The full hopper is then raised onto the frame and the patching operation commensed.

Once the hopper 14 is loaded with asphalt, raised and the burner ignited in the auger tube, the bucket 18 is moved around under the outlet opening 80 and button 92 depressed to operate the hopper auger, filling the bucket. The control stick is then operated to move the bucket over the hole to be patched, assuming, of course, the machine has been driven to the point of use. The burner assembly may be lowered, if desired, and then actuated and ignited. This cleans the hole of trash and heats the surrounding asphalt. After heating, the burner is extinguished, and tack oil may be sprayed into the heated hole by depressing button 94. Other type of liquid may, also, be used in the operation. Button 90 is actuated to open the bucket door and asphalt is spread by actuating the spreader by depressing button 95. When sufficient asphalt is discharged into the hole, the spreader and door buttons are released. The tamper height button 91 is depressed to actuate the cylinder for the tamper height adjustment, and a foot actuated switch (not-shown) depressed to actuate the tamper cylinder. During tamping, if additional asphalt is required, it is easily added, as explained above. When completed the bucket is moved to a different pothole requiring patching.

A sole operator may thus replace a crew of four or five workers. A supply truck may accompany the patching machine at a distance from the hot mix plant. The tamper with the bevelled sides and being about 7½ inches square, is capable of tamping most potholes without bridging from side to side over the hole and thus produce highly compacted patch. The bevelled sides are very effective in the tamping action, as they slightly tamp the surrounding asphalt.

What is claimed is:

1. In a wheeled asphalt patching machine having an elevatable supply hopper for asphalt and a transfer bucket on an articulated arm, and including tamper means and burner means, tack oil spray, mounted on and movable with the bucket, and auger means extending from internally of the supply hopper to a supply position for the bucket, the improvement of:

(a) open top trough means housing the auger means and extending from the supply hopper to the supply position for the bucket, (b) a height adjustable frame assembly mounted on the bucket carrying said burner means, (c) lower outlet means for said bucket including release means and spreading means for asphalt from the transfer bucket, and (d) adjustable height frame means carrying the tamper means mounted on the bucket.

2. In a wheeled asphalt patching machine having an elevatable supply hopper having an outlet for asphalt and a transfer bucket on an articulated arm, and including tamper means and burner means mounted on, and movable with the bucket, and auger means extending from internally of the hopper to a supply position for the bucket, the improvement of:

(a) an open top trough extending from the supply hopper outlet to a trough outlet at the supply position for discharge into the transfer bucket, and (b) said auger means including auger extension means extending through said trough from the hopper outlet to the trough discharge outlet.

3. The improvement of claim 2, wherein said open top trough includes upstanding sides from the supply hoppper to the discharge outlet.

4. The inprovement of claim 3, wherein the top edge of said sides slope downwardly from the supply hopper to the discharge outlet.

5. The improvement of claim 2, wherein said auger extension means includes a hollow tube and burner means arranged to heat said tube and surrounding asphalt material.

6. The improvement of claim 2, wherein said auger extension means is a spiral flight conveyor.

7. The improvement of claim 6, wherein said spiral flight conveyor is rotatably mounted adjacent the bottom of the trough.

8. In a wheeled asphalt patching machine having an elevatable supply hopper for asphalt and a transfer bucket on an articulated arm, and including tamper means and burner means with tack oil sprayer means mounted on and movable with the bucket and auger means extending from internally of the hopper to a supply position for the bucket, the improvement of:

(a) the burner assembly means being mounted on the adjustable frame assembly on the bucket with downwardly directed burners;

(b) means reciprocably mounted said burner assembly on said frame assembly in a vertical direction, and;

(c) means actuating said means reciprocably mounting said burner assembly for reciprocating said burner assembly in a vertical direction.

9. The improvement of claim 8, wherein said means for reciprocating said burner assembly is a hydraulic cylinder.

10. The improvement of claim 8, being further characterized by a tack oil sprayer mounted on said frame assembly for movement with said burner assembly, means for feeding tack oil to said sprayer, and control means for independantly operating either said burner assembly and said tack oil sprayer.

11. In a wheeled asphalt patching machine having an elevatable supply hopper for asphalt and a transfer bucket on an articulated arm, and including tamper means and burner means mounted on and movable with the bucket and auger means extending from internally of the hopper to a supply position for the bucket, the improvement of:

(a) lower outlet means on the transfer bucket including sliding door means;

(b) means for reciprocating said sliding door means of said lower outlet means; and, (c) means mounted in the transfer bucket for aiding discharge of asphalt through said lower discharge means and spreading the same as it is discharged.

12. The improvement of claim 11, wherein said means for reciprocating said sliding door means on the transfer bucket is a hydraulic cylinder.

13. The improvement of claim 12, wherein said means in the transfer bucket includes a rotary mixer adjacent said lower outlet means on the transfer bucket.

14. The improvement of claim 13, wherein said rotary mixer includes plural projections on a shaft for mixing and spreading discharged asphalt, and means for rotating said shaft.

15. The improvement of claims 1, and 11 further characterized by joy stick controller arranged to be movable around 360° and contact control switches for the articulated arm at about 45° intervals, and a plurality of on-off, on switches on the joy stick for controlling the operation of the patching equipment.

* * * * *